US005208580A

United States Patent [19]

Crossfield

[11] Patent Number: 5,208,580

[45] Date of Patent: May 4, 1993

[54] SECURITY TAG ATTACHMENT

[76] Inventor: Michael D. Crossfield, Perne Drift, Burton End, West Wickham, Cambridge, England

[21] Appl. No.: 631,248

[22] Filed: Dec. 20, 1990

[30] Foreign Application Priority Data

Dec. 21, 1989 [GB] United Kingdom ..... 8928966

[51] Int. Cl.[5] ..... G08B 13/14

[52] U.S. Cl. ..... 340/571; 340/568; 70/57.1

[58] Field of Search ..... 340/568, 571, 572; 439/37, 511, 507; 24/704.1, 706.1; 70/57.1

[56] References Cited

U.S. PATENT DOCUMENTS 595,286 12/1897 Candel ..... 24/704.1

4,812,811 3/1989 Äsbrink ..... 340/571

FOREIGN PATENT DOCUMENTS 341828 4/1989 European Pat. Off. .

*Primary Examiner*—Jin F. Ng

*Assistant Examiner*—Christine K. Oda

*Attorney, Agent, or Firm*—Sixbey, Friedman, Leedom & Ferguson

[57] ABSTRACT

An attachment device for a security or antipilferage tag, and a combination of such a device with the tag. The attachment device comprises a cap having an upper surface and a lower surface, and a pair of electrically conductive pins depending from the lower surface, and an electrical conductor within the body of said cap which makes an electrical connection between the pair of pins. The tag forming one element of the combined tag and attachment device includes a first opening adapted to receive one of the pins and to permit electrical contact between the one pin and a first part of the electrical circuit within the tag, and a second opening adapted to receive the other of the pair of pins and to permit electrical contact between the other pin and a further part of the electrical circuit within the tag. Unauthorised removal of the attachment device from the tag results in the generation of an alarm signal.

4 Claims, 1 Drawing Sheet

SECURITY TAG ATTACHMENT

Figure 1:
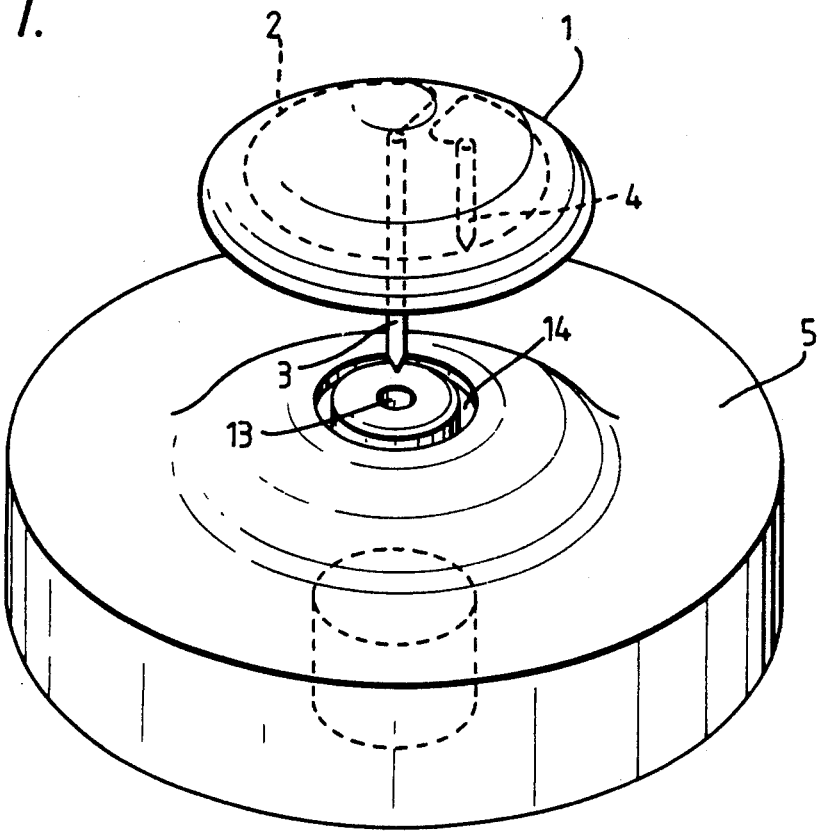

This invention relates to a security or antipilferage tag and is particularly concerned with the means for attaching the tag to an article.

The majority of "active" security labels used in retail security systems use a single pin form of attachment, usually employing a magnetically-released locking mechanism for the pin shaft. There are a number of disadvantages to this basic scheme, the most important of which are:

a) It is very difficult to detect that the head of the pin has been severed.

b) The weight of the tag is carried on a single pin shaft, leading to damage to delicate materials.

We have devised an arrangement which overcomes or ameliorates these disadvantages and which characteristically uses an attachment (sometimes known as a "pin") with two prongs and, preferably, a domed clamping area. More particularly, the present invention provides, in one aspect, a device for attaching a security tag to an article of merchandise, which comprises a cap having an upper surface and a lower surface, and a pair of pins depending from said lower surface of the cap, characterised in that (a) each of said pins is electrically conductive or includes within it an electrically conductive pathway; and (b) an electrical conductor is provided within the body of said cap which makes an electrical connection between the pair of pins.

Preferably, the cap is generally circular in form, most advantageously being domed in shape, e.g. the cap may have a convex upper surface an a concave lower surface.

One of said pair of pins is preferably located at the center of the lower surface of said cap, and the other of said pair of pins is preferably located intermediate the center of the cap and the periphery thereof. Conveniently, the centrally located pin is longer than the other pin.

The electrical conductor within the body of said cap is preferably shaped and located so as to act as a strengthening element.

According to a second aspect of the present invention, there is provided a security or antipilferage tag and means for attaching the tag to an article of merchandise, wherein the tag comprises an electrical circuit including means for generating an alarm signal under predetermined conditions, and wherein the attachment means is shaped so as to fit against a surface region of the tag whereby a portion of the article of merchandise is clamped between the tag and the attachment means, thereby retaining the tag on the article of merchandise, the attachment means comprising a cap having an upper surface and a lower surface, and a pair of pins depending from said lower surface of the cap, characterised in that: (a) each of said pins is electrically conductive or includes within it an electrically conductive pathway; (b) an electrical conductor is provided within the body of said cap which makes an electrical connection between the pair of pins; and (c) the tag includes a first opening adapted to receive one of said pins and to permit electrical contact between said one pin and a first component or part of the electrical circuit within the tag, and a second opening adapted to receive the other of said pair of pins and to permit electrical contact between said other pin and a further component or part of the electrical circuit within the tag.

Preferably, a combined tag with attachment means in accordance with this invention has the same preferred characteristics as set out above in relation to the attachment device alone. Thus said cap is preferably circular in form and with a generally domed shape or configuration; and one of said pair of pins is preferably centrally located, while the other of said pair of pins is preferably located intermediate the center of the cap and the periphery thereof.

The first opening in said tag is preferably a centrally located pin hole orifice, and said second opening is preferably an annular channel. Advantageously, the annular channel includes an inward-facing, electrically conductive 'O'-ring seal which, in use, is contacted by the other of said pair of pins (the 'O'-ring seal thereby constituting said other component or part of the electrical circuit within the tag). Likewise, the tag preferably includes a magnetic clamping element located at the lower extremity of said pin hole orifice and arranged to receive and to hold tightly the lower end of the centrally located one of the pair of pins (the magnetic clamping element thereby constituting said first component or part of the electrical circuit within the tag).

Advantageously, the electrical circuit within the tag is arranged to generate an alarm signal when a connection between said first component or part and said further component or part is broken. Thus while the attachment means is properly fitted to the tag (with the article of merchandise clamped between them), the tag is quiescent. In the event that the attachment means is tampered with, e.g. by forcibly pulling it away from the tag, the electrical connection between the two parts of the circuit within the tag is broken, and this is used to trigger the desired alarm signal.

Preferably the tag is an 'active' tag—i.e. one which generates an alarm tone when the predetermined circuit conditions are fulfilled (e.g. the electrical connection—as described in the preceding paragraph—is broken). A preferred form of active tag is disclosed in European Patent Publication EP 0341828A.

When an article of merchandise bearing a security tag with attachment means in accordance with the present invention is taken by a bona fide customer to a point of sale within, for example, a store, the sales assistant will remove the tag by following a predetermined series of steps which serve to release the attachment means from the tag without generating an alarm; typically (but not exclusively) this will involve placing the tag onto an element which generates a strong magnetic field which serves to release the magnetic clamping element within the tag, thereby freeing the central pin and thus allowing easy removal of the attachment means form the tag. Alarm generation may be prevented in a number of ways at the point of sale, and these techniques do not form a part of the present invention; for illustration, however, it may be mentioned that a strong magnetic field of the type just described can be an alternating field of a characteristic frequency which interacts with element(s) within the tag to prevent alarm signal generation, despite the broken electrical connection between the two parts of the circuit as described above. After removal of the tag from the article of merchandise, the tag may be returned for further use (possibly after reactivation treatment) and the purchaser is free to leave the store with the merchandise.

Figure 2:
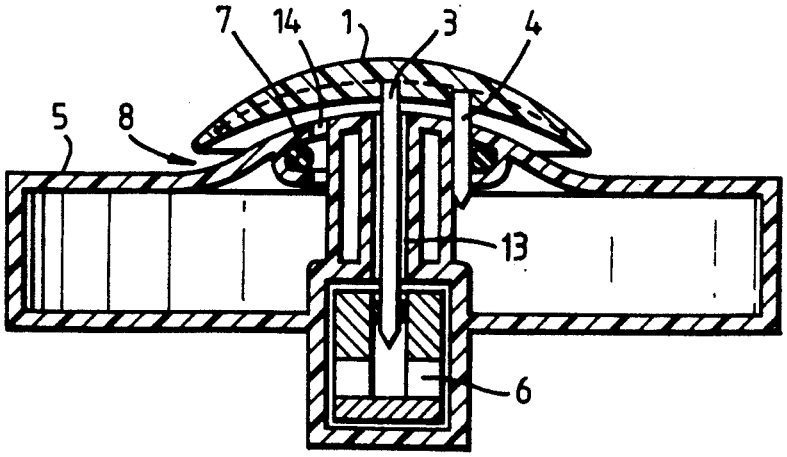

The invention is illustrated in the accompanying drawings, in which FIG. 1 is a perspective view of a tag in accordance with this invention, and FIG. 2 is a radial section through the tag of FIG. 1.

With reference to the drawings, the attachment means comprises a cap 1 (which resembles in its general form the head of a drawing pin). As best seen from FIG. 2, the cap is circular in form, with a convex upper surface and a concave lower surface, thereby presenting a domed clamping area to security tag 5 with which the cap 1 cooperates. The cap is of large diameter to maximise the damage which would be caused by removal of the tag from an article of merchandise by physically cutting the material away around the periphery of cap 1. A wire 2 embedded in the material of the pin head links two rigid, electrically conductive pins or prongs 3 and 4 which depend from the lower surface of cap 1. The bulk of the cap 1 is formed of an electrically insulating material, and may (for example) be a plastics material. The electrical connection between pins 3 and 4 allows a circuit to be completed when the attachment device is inserted into the tag 5. The electrical connection wire 2 is looped around the periphery of the cap 1 as shown in order to provide a physical reinforcement or strengthening effect. In order to facilitate insertion of the attachment device in to the tag 5, the configuration uses a centrally positioned pin 3 whose length is greater than that of the other pin 4. Pin 3 is arranged to enter a pin-hole orifice 13 at the centre of the top surface of tag 5. This makes initial insertion of the pin 3 into hole 13 very simple. An annular channel 14 is positioned intermediate the central hole 13 and the periphery of tag 5 so that it can receive the other pin 4 of the attachment device. Once pin 3 has mated with hole 13, the second pin 4 automatically enters the annular contact orifice 14. The use of this annular arrangement makes user-alignment of the second pin 4 unnecessary.

The attachment device can be retained in the tag by clamping the centre pin by any suitable means, e.g. by a magnetically-releasable clamp 6. This clamp is also a convenient means for making electrical connection to the central pin 3. A particularly convenient method of making electrical contact to the other pin 4 is via an electrically-conductive rubber 'O'-ring 7 set into the tag casing and facing inwardly towards the annular channel 14. This will provide sufficient side force to ensure a reliable electrical contact, and since only a low current needs to flow, a low resistance is not required. Clearly alternative electrical contacts using metal-to-metal contacts could also be used, but these are potentially more expensive and unreliable.

The use of two pins 3 and 4 automatically reduces the potential for damage to delicate fabrics or materials which might otherwise be caused by the weight of the tag clamped to the attachment device. The situation can be further improved by adopting the domed shape as illustrated in FIG. 2 for the area 8 between the tag case and cap 1. This causes the load on the tag to be distributed over a much greater area of material (which is clamped between the domed cap 1 and the tag 5) than would otherwise be the case.

I claim:

1. A security or antipilferage tag and means for attaching the tag to an article of merchandise, wherein the tag comprises an electrical circuit including means for generating an alarm signal under predetermined conditions, and wherein the attachment means is shaped so as to fit against a surface region of the tag whereby a portion of the article of merchandise is clamped between the tag and the attachment means, thereby retaining the tag on the article of merchandise, the attachment means comprising a generally circular cap having an upper surface and a lower surface, and a pair of pins depending from said lower surface of the cap, wherein (a) each of said pins is electrically conductive or includes within it an electrically conductive pathway; (b) an electrical conductor is provided within the body of said cap which makes an electrical connection between the pair of pins; (c) one of said pair of pins is located at the center of the lower surface of said cap and the other of said pair of pins is located intermediate the center of the cap and the periphery thereof; and (d) the tag includes a first opening in the form of a centrally located pin hole orifice adapted to receive the central pin of said attachment means and to permit electrical contact between said central pin and a first component of the electrical circuit within the tag, and a second opening in the form of an annular channel adapted to receive the other of said pair of pins of said attachment means and to permit electrical contact between said other pin and a further component of the electrical circuit within the tag.

2. A tag with attachment means as claimed in claim 1, further characterized in that said annular channel includes an inward-facing, electrically conductive 'O'-ring seal which, in use, is contacted by the other of said pair of pins.

3. A tag with attachment means as claimed in claim 1, characterised in that the tag includes a magnetic clamping element located at the lower extremity of said pin hole orifice and arranged to receive and to hold tightly the lower end of the centrally located one of the pair of pins, (said magnetic clamping element thereby constituting said first component or part of the electrical circuit within the tag).

4. A tag with attachment means as claimed in claim 1, characterised in that the electrical circuit within the tag is arranged to generate an alarm signal when a connection between said first component and said further component is broken.

* * * * *